US007386951B2

(12) United States Patent
Bartholomew

(10) Patent No.: US 7,386,951 B2
(45) Date of Patent: Jun. 17, 2008

(54) PICTURE FRAME/SHELF COMBINATION

(76) Inventor: Rebecca Bartholomew, 24 Eckhard Ave., Wood River, IL (US) 62095

( * ) Notice: Subject to any disclaimer, the term of this patent is extended or adjusted under 35 U.S.C. 154(b) by 260 days.

(21) Appl. No.: 11/045,889

(22) Filed: Jan. 28, 2005

(65) Prior Publication Data

US 2006/0168863 A1 Aug. 3, 2006

(51) Int. Cl.
*A47G 1/06* (2006.01)

(52) U.S. Cl. ..... 40/727; 40/603

(58) Field of Classification Search ..... 40/603, 40/800; 38/102.91; D6/301; 160/371, 378
See application file for complete search history.

(56) References Cited

U.S. PATENT DOCUMENTS 3,678,607 A * 7/1972 Tabor et al. ..... 38/102.91
D249,435 S 9/1978 Ishmael
D263,185 S 3/1982 Scholl
D264,414 S 5/1982 Missir
D266,889 S 11/1982 Frechtman
5,261,172 A * 11/1993 Rowley ..... 40/124.08
D348,782 S 7/1994 Borja
D350,235 S 9/1994 Smith
5,365,683 A 11/1994 Borja
D355,305 S 2/1995 Pruitt
D369,473 S 5/1996 Gluck
D371,911 S 7/1996 Peterson et al.
D402,122 S 12/1998 Grant
D405,961 S 2/1999 Stangl et al.
D407,665 S 4/1999 Churchville
5,987,789 A * 11/1999 Lubina ..... 38/102.4
D423,796 S 5/2000 Kwan
D427,440 S 7/2000 Rowan
D455,273 S 4/2002 Harwanko
D457,733 S 5/2002 Sussman et al.
D464,206 S 10/2002 Moncourtois et al.
D468,350 S 1/2003 Sussman et al.
2002/0108287 A1* 8/2002 Tran ..... 40/800
2003/0033745 A1* 2/2003 Ribaudo ..... 40/800

* cited by examiner

*Primary Examiner*—Joanne Silbermann
(74) *Attorney, Agent, or Firm*—Thompson Coburn LLP; Benjamin L. Volk, Jr. Esq.

(57) ABSTRACT

Apparatus and methods for personalizing a picture. In a preferred embodiment, the invention provides a picture display apparatus including a body, a shelf extending from the body, and a plurality of pre-selected accessories. Preferably, a peel-off adhesive removably adheres the accessories to the shelf. Also, the body may define a border around a picture display area. Further, the body and the shelf may be portions of a unitary member. The invention also provides a picture display apparatus that includes an L-shaped body, a display area, a shelf, an accessory, and an adhesive. The display area is on the front of the vertical member of the L-shaped body whereas the horizontal member of the body defines an accessory shelf. In another preferred embodiment, a picture display apparatus for displaying a cross-stitched picture held on a stretcher frame is provided.

23 Claims, 3 Drawing Sheets

PICTURE FRAME/SHELF COMBINATION

FIELD OF THE INVENTION

This invention relates generally to picture display apparatus and, more particularly, picture display apparatus that can be personalized by the user.

BACKGROUND OF THE INVENTION

Consumers frequently wish to display pictures on the walls of their homes, offices, workshops, classrooms, and other surrounding structures. These pictures frequently include scenes that are relevant to one or more hobbies, occupations, or interests of the consumer. Because the consumer's interests change with time, the consumer may wish to modify the manner in which the picture is displayed. Moreover, the user may wish to personalize the picture displayed in the picture display apparatus particularly if the picture was not taken (in the case of a photograph), drawn, painted, or otherwise created by the user. A particular type of picture that the user may wish to personalize is a cross-stitched picture to which the user may have devoted considerable time, effort, and attention.

One manner of personalizing a picture includes displaying the picture near a shelf on which the consumer places souvenirs, mementos, and keepsakes related to the picture in the frame. Typical examples of these mementos include baseballs placed under the picture of a favorite player and trophies placed under a photograph of an award ceremony. However, these mementos can become separated from the picture display apparatus or otherwise become lost. Additionally, the mementos can be fragile and subject to damage if they become dislodged from the shelf and fall to the floor. Further, the user may wish to move the picture. But the new location may be without a nearby shelf on which to display the mementos. In this case, the user will need to hang a shelf at the new location to continue displaying the mementos with the picture.

Thus a need exists for improved methods and apparatus for displaying pictures.

SUMMARY OF THE INVENTION

It is in view of the above problems that the present invention was developed. The invention provides improved picture display apparatus and methods of displaying pictures.

In a first preferred embodiment, the present invention provides a picture display apparatus that can be personalized by a user. The picture display apparatus includes a frame and a shelf that extends from the bottom of the frame. Accessories that coordinate with the picture being displayed in the frame stick to the shelf by way of a peel-off adhesive. An example of a coordinated picture and accessory is a picture within a frame of a young child playing at the beach and a miniature beach ball (or seashells) being stuck on the upward-facing portion of the shelf. Preferably, the accessories are provided in a pre-selected set of accessories with a portion of the peel-off adhesive already attached to each accessory. Frames of various sizes (e.g. 8 by 10 inches or 5 by 7 inches) are provided as well as shelves of various sizes. One preferred shelf extends outwardly from the frame by about 3 and ¼ inch and is about 1 inch thick between its upward-facing portion and its downward-facing portion. Likewise, the vertical sides of the frame are preferably about 1 inch wide and 1 inch deep. The picture display apparatus, including the shelf, may also be made as one-piece via injection molding.

In a second preferred embodiment, the invention provides a picture display apparatus that includes a body, a shelf extending from the body, and a plurality of pre-selected accessories. The accessories are removably adhered to the shelf. Preferably, a peel-off adhesive adheres each of the accessories to the shelf. Also, the body may define a border around a picture display area (e.g. a recess). Further, the body and the shelf may be portions of a unitary member. The shelf is preferably below the border and preferably extends along the entire bottom edge of the frame. Accessories which have a height about the same as the width of the border can be displayed on the shelf without obstructing the user's view of the displayed picture. Also, the thickness of the shelf and the depth of the vertical member may be may be about the width of the border.

In a third preferred embodiment, the invention provides a picture display apparatus that includes an L-shaped body that defines a display area and a shelf, an accessory, and an adhesive. The display area is on the front of the vertical member of the L-shaped body, whereas the horizontal member of the body defines a shelf to which the accessory can adhere. A first border portion of the L-shaped body can define the right side of the frame, a second border portion of the L-shaped body can define the left side of the frame, a third border portion of the L-shaped body can define the top of the frame, and the shelf can define the bottom of the frame.

In another preferred embodiment, the present invention provides a picture display apparatus that includes a body with a generally rectangular border. The border defines a generally rectangular aperture that is adapted to accept and hold a stretcher frame for holding a cross-stitched picture in a taut condition. Preferably, the border defines a step along at least one side of the aperture that defines a first width and a second width of the aperture. The first width can be approximately the width of a cross stitch picture whereas the second width can be approximately the width of a stretcher frame. Further, the border may include a notch that is adjacent to the aperture for accepting a portion of a dowel of the stretcher frame. Also, the border can define a crenellated ridge of the border adjacent to the aperture for hanging the picture display apparatus. The picture display apparatus may also include a shelf extending from the bottom and front side of the border. In any case, the body of the picture display apparatus may be a one-piece body.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate exemplary embodiments of the present invention and together with the description, serve to explain the principles of the invention. In the drawings.

DETAILED DESCRIPTION OF THE PREFERRED EMBODIMENTS

Figure 1:
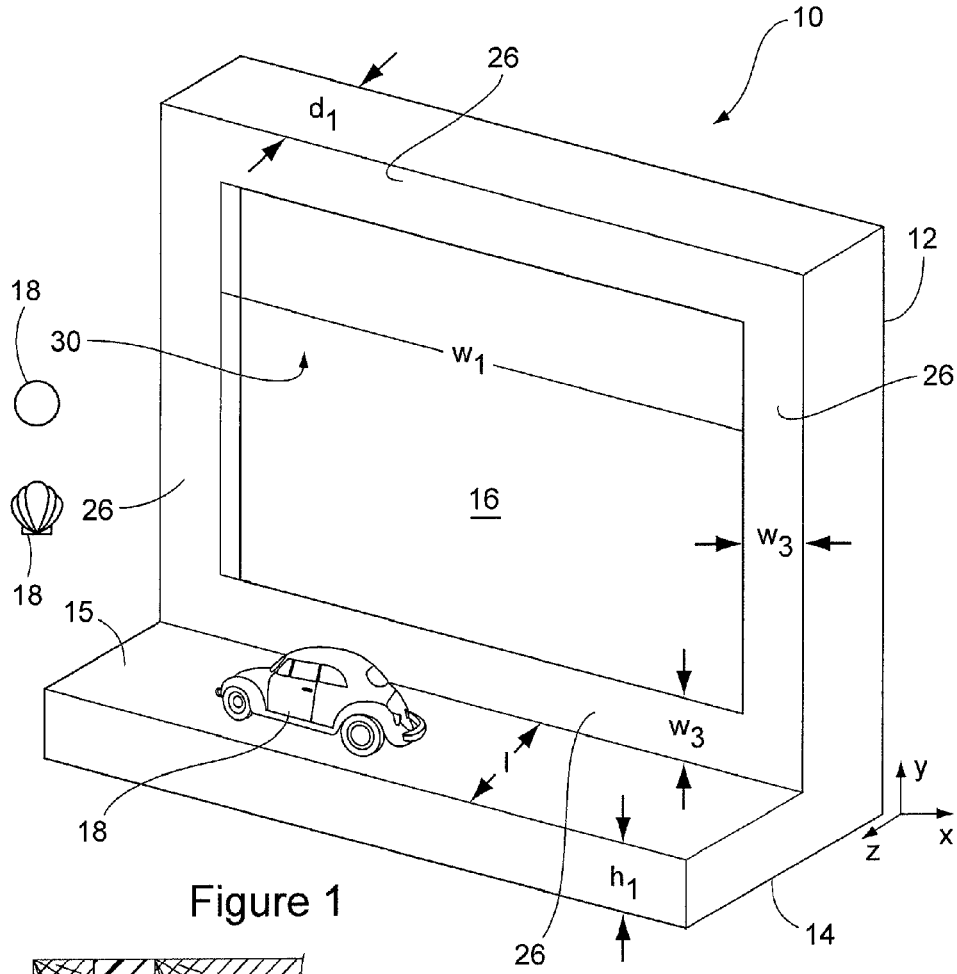
FIG. 1 illustrates a perspective view of a picture display apparatus constructed in accordance with the principles of the present invention.

Referring to the accompanying drawings in which like reference numbers indicate like elements, FIG. 1 illustrates picture display apparatus constructed in accordance with the principles of the present invention.

The picture display apparatus 10 of FIG. 1 includes a frame 12, a shelf 14, a display area 16, and an accessory 18. Together, the frame 12 and the shelf 14 form a single, unitary member of injection molded plastic (e.g. polyurethane) or other material suitable for forming the picture display apparatus (e.g. wood). With the shelf 14 extending horizontally from the bottom and front side of the upright frame 12, the shelf 14 and the frame 12 form an "L" shaped body. In the L-shaped body, the frame 12 corresponds to the vertical leg of the "L" and the shelf corresponds to the horizontal leg of the "L." Any picture of an appropriate size and shape can be attached to, secured in, or held within the display area 16 which is positioned above the shelf 14. Various accessories 18 can be placed on and adhered to the shelf 14 (preferably on the upward-facing portion 15 of shelf 14) so that individuals viewing the picture will see the accessory 18 on the shelf 14 in a coordinated manner.

In a preferred embodiment, the accessory 18 is attached to the shelf 14 via a "peel-off" adhesive 20. Peel-off adhesives typically include a layer of adhesive 22 and a paper or plastic cover 24. The layer of adhesive 22 adheres securely to the article 18 while adhering less securely to the cover 24. Thus, the cover 24 can be peeled off of, or removed from, the adhesive 22. Also, the adhesive 22 is selected so that the it allows the accessory 18 to be removably adhered to the shelf 14. In an alternative embodiment, the peel off adhesive can be affixed to the shelf 14, with the cover 24 pointing in an upward direction before the cover is removed for exposing the adhesive 22. In any case, a user can select an accessory 18 that relates to the current picture displayed in the display area 16 and later change accessory selections by simply removing the current accessory 18 from the shelf 14 and replacing it with another accessory 18.

Figure 3:
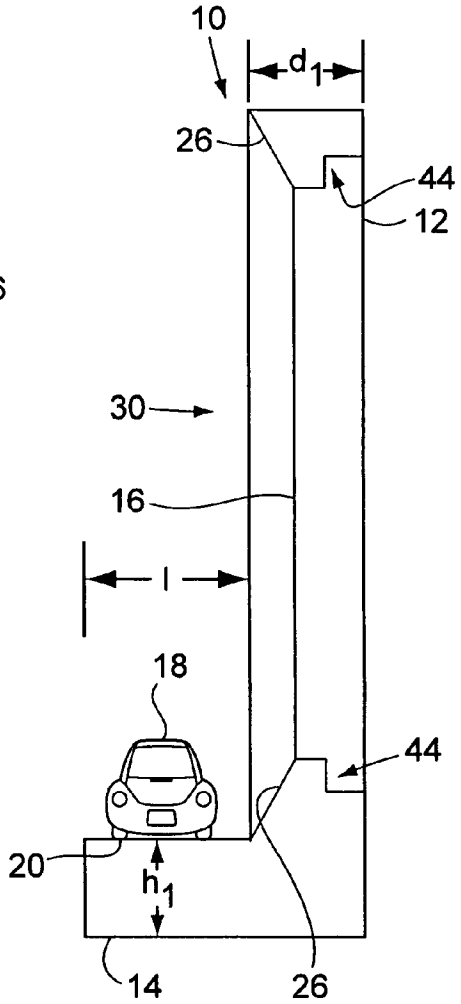
FIG. 3 illustrates a cross sectional view of the picture display apparatus as seen from line 3-3 in FIG. 2.

In another preferred embodiment, the picture display apparatus 10 includes a border 26 that surrounds the display area 16. The border can be created by forming a recess 30 (see FIG. 3) in the front surface of the frame 12. The recess 30 then serves as the display area 16 with the remaining raised surface being the border 26. While FIG. 3 shows the border 26 as having ramped sides, other preferred embodiments include borders 26 having stepped or straight sides.

Figure 6:
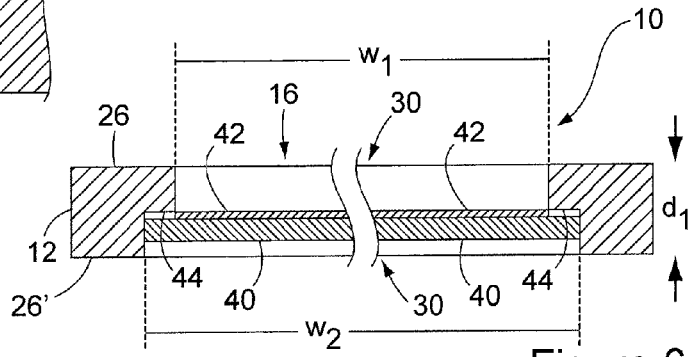
FIG. 6 illustrates a cross sectional view of the picture display apparatus of FIG. 1 as seen along line 6-6 as shown in FIG. 5.
Figure 5:
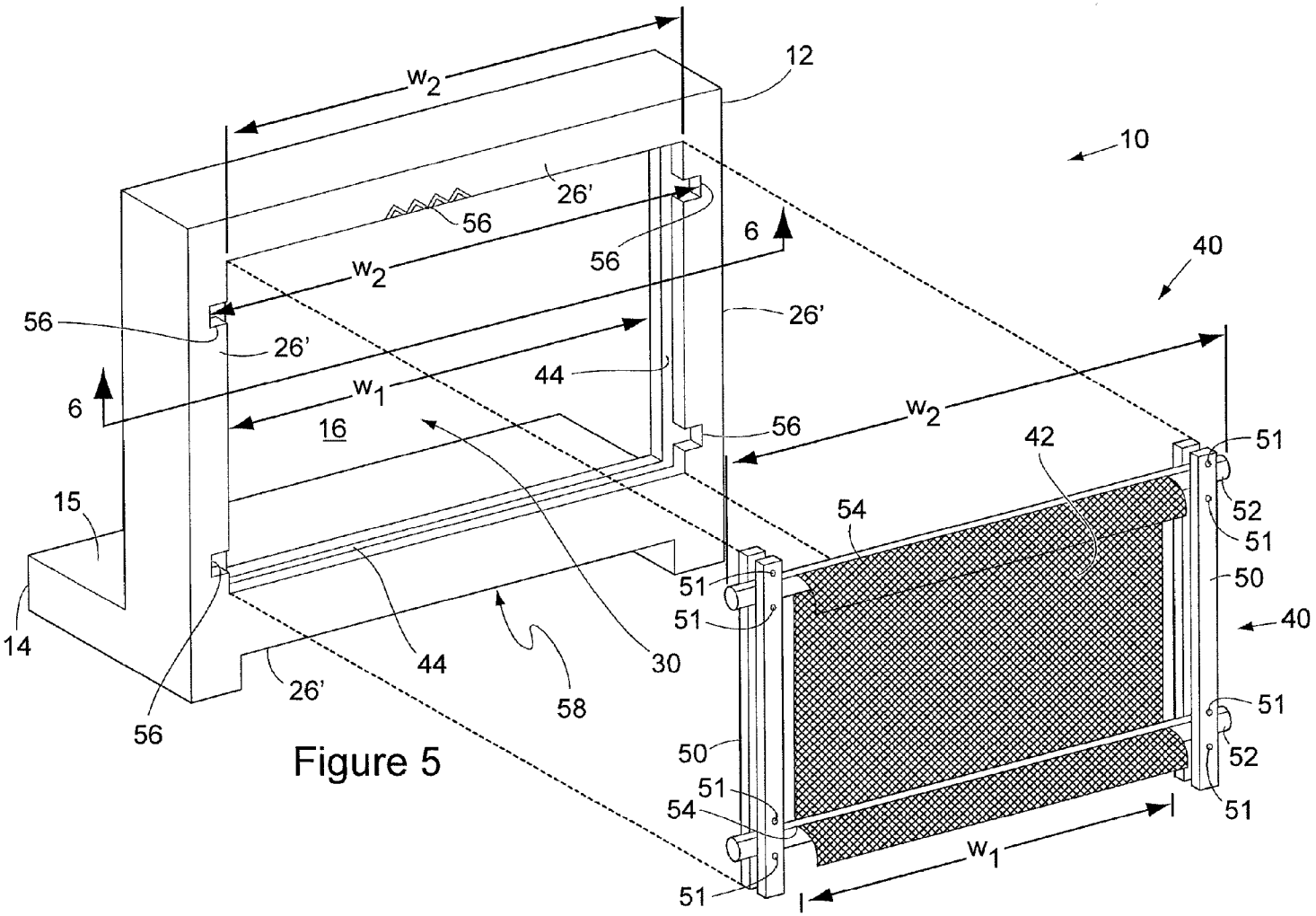
FIG. 5 illustrates a perspective view of the picture display apparatus of FIG. 1 as seen from the rear and right side.

In yet another preferred embodiment, the recess 30 penetrates the entire depth of the vertical leg of the display apparatus 10. Thus, the recess 30 forms an aperture extending from the front side of the picture display apparatus 10 to the back side of the picture display apparatus 10. Whether the aperture (or recess) 30 extends through the picture display apparatus 10, or not, the aperture 30 can be dimensioned and shaped to hold a stretcher frame 40 for holding a cross-stitched picture 42 as shown in FIGS. 5 and 6. The stretcher frame 40 is a device that is used to hold the fabric of the cross-stitched picture 42 taut while the picture 42 is being made by the user. As will be discussed, it is preferred that the cross-stitched picture 42 be held on the stretcher frame 40 which in turn is held by the display apparatus 10 for displaying the picture 42. In any case, the border 26, or rear border 26' of the frame 12 can define steps 44 along the periphery of the aperture 30. The steps 44 define a width "w1" on the front side of the frame 12 (see FIG. 6) that is about equal to the nominal width of a typical cross-stitched picture 42. Also, the steps 44 define another width "w2" that is about equal to the overall width of a typical stretcher frame 40.

Note that the term "width" will generally refer hereinto dimensions along the x axis shown in FIG. 1. The term "height" will generally refer to dimensions along the y axis and the term "depth" will generally refer to dimensions along the z axis. Although those skilled in the art will recognize that some exceptions to this terminology are appropriate. For instance, referring to the width "w3" of the lower portion of the border 26, rather than referring to the height of the border 26, is appropriate.

The steps 44 also define heights of the recess 30 that correspond to the height of a cross-stitched picture 42 and the height of a stretcher frame 40. Thus, as FIGS. 5 and 6 show, the stretcher frame 40 can be slid into the rear of the recess 30 until either the stretcher frame 40 or cross stitch picture 42 (or both) contact the frame 12 at the step 44. In this manner, the frame 12 can be used to display the cross-stitched picture 42 while, preferentially, concealing the stretcher frame 40 from being viewed from the front side of the picture display apparatus 10.

While stretcher frames 40 are well known in the art, a brief discussion of the stretcher frame 40 will aid in understanding the advantages offered by the present invention. A typical stretcher frame 40 is shown in FIG. 5 and includes a pair of spreader rails 50, a pair of dowels 52 that each include a slot 54, and bolts, wing nuts, or other fasteners 51 to secure the spreader rails 50 and the slotted dowels 52 together. To create a cross-stitched picture 42, one end of the fabric for the cross-stitched picture 42 is first inserted into one of the slots 54. The other end of the fabric is then inserted into the other slot 54. One or both dowels 52 are rotated to draw the fabric taut between the dowels 52. While FIG. 5 shows the ends of fabric extending from the dowels 52, in actuality, the fabric will typically be wrapped around the dowels 52 as the user pulls the fabric taut using the dowels 52. The fasteners 51 are then tightened to secure the dowels 52 in position while holding the fabric taut. With the fabric held in this manner, the user can then cross stitch a picture 42 into the fabric while advancing the fabric with the dowels 52, if necessary, to complete the picture. Conventionally, once complete with the picture 42, the user then removes the cross-stitched picture 42 from the stretcher frame 40 and displays it as best the user can in a loose, or slack, condition. Unfortunately, wrinkles and folds in the fabric, which are not visible when the fabric is taut, distort the cross-stitched picture 42 when the fabric is slack. One of the advantages provided by the present invention, therefore, is that the cross-stitched picture 42 can remain on the stretcher frame 40 in its taut condition with the wrinkles and folds smoothed into a pleasing aesthetic condition for display in the display apparatus 10.

Friction between the steps 44 and the stretcher frame 40 can hold the picture 42 in the display apparatus 10. In the alternative, notches 56 can be provided in the border 26 into which portions of the dowels 52 (which extend beyond the rails 50) fit. Additionally, notches can also be provided in the border 26 for receiving the portions of the rails 50 that extend beyond the dowels 52. The notches 56 (whether for the rails 50, the dowels 52, or both) help to securely hold the picture 42 in the display apparatus 10. Fasteners, straps, clips, or their equivalents can also be provided to hold the picture 42 in the display apparatus 10.

Other features of the present invention are also shown by FIG. 5. For instance, a crenellated ridge 56 can be formed at one, or more, locations along the back edge of the recess 30 to allow the picture display apparatus 10 to hang from a hook, nail, or other equivalent means of hanging the display apparatus 10 from a surface. Also, FIG. 5 shows a void 58 along the rear border 26' that allows a reduced weight and material savings, for the picture display apparatus 10. The weight savings provided by the void 58 allows the picture display apparatus 10 to hang from smaller hooks or nails than might otherwise be the case.

Figure 2:
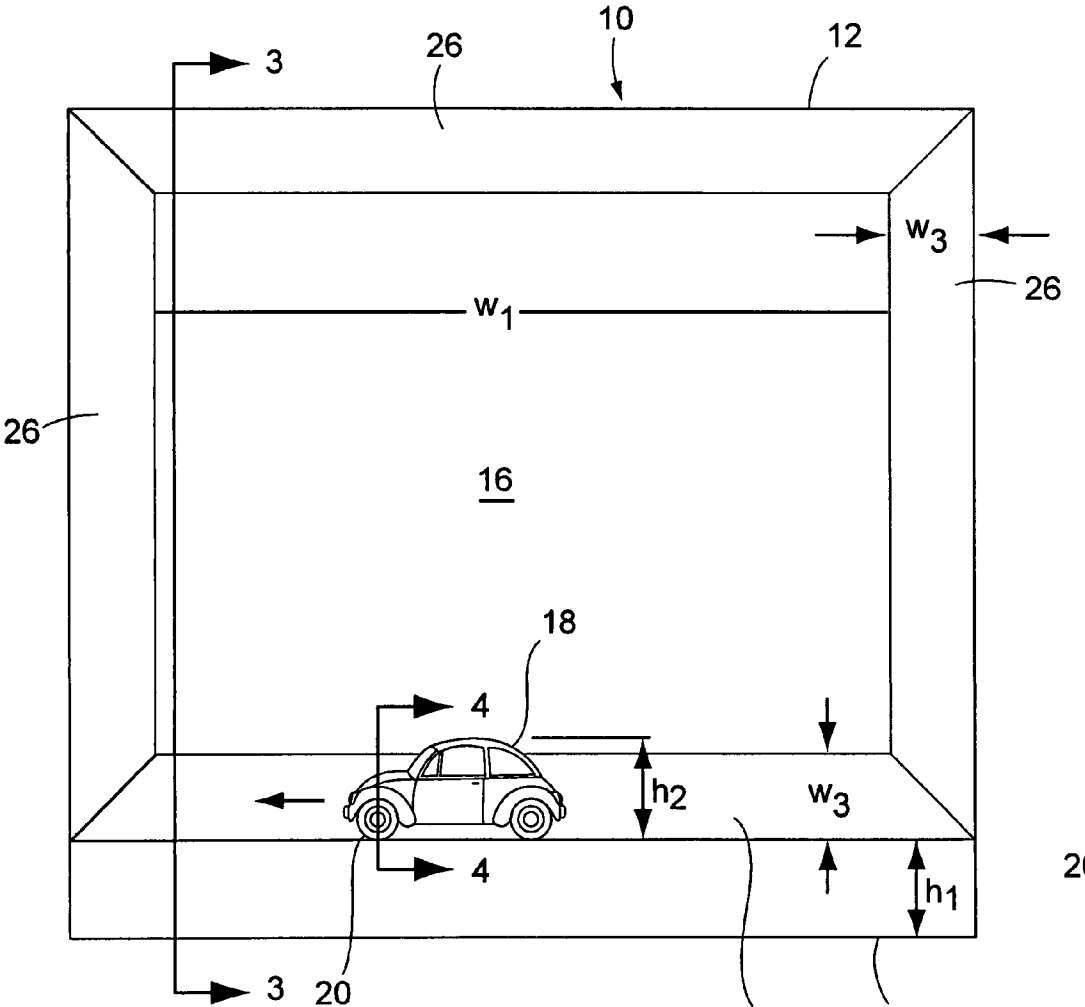
FIG. 2 illustrates a front elevation view of the picture display apparatus of FIG. 1.

With reference again to FIG. 1, the display area 16 can be sized to display any size of picture, photograph, or other object which the user wishes to display. However it is preferred that the display area 16 be sized to allow the display of pictures of standard sizes such as 5"×7" or 8"×10" pictures or cross-stitched pictures 42. Preferably, the width "w3" of the border is about 1". Likewise, the frame 12 and the shelf 14 can be about 1 inch deep and high, respectively, as shown by reference "$d_1$" and "$h_1$", respectively. Thus, in a preferred embodiment, the depth and thickness of the one piece-body of the picture display apparatus 10 and the width of the border are about equal and thus provide the picture display apparatus 10 with a pleasing aesthetic appearance as well as sturdiness. Further, the accessories 18 can be miniaturized replicas of objects that coordinate with the picture displayed in the display area 16. As shown by FIG. 2, a preferred height "h2" of an accessory 18 is less than the width "w3" of the border 26 so that the accessory does not obstruct the user's view of the display area 16. However, the height "h2" of the accessory 18 can exceed the width "w3" of the border 26 without departing from the scope of the present invention. Moreover, some users may actually prefer to use accessories 18 that somewhat overlap the display area 16 when viewed from in front of the picture display apparatus 10. Another preferred embodiment provides a shelf 14 that extends a length "l" of about 3 and ¼ inches from the front of the frame 12 to provide space on which the accessories 18 can be placed.

In operation, the user can hang the picture display apparatus 10 on a wall or other surface. In the alternative, the user can set the picture display apparatus 10 on a surface (e.g. a floor, table, of counter top) using the shelf 14 as a base to help steady the picture display apparatus 10. A picture can then be placed in the display area 16, for example by inserting a cross-stitched picture 42 (on a stretcher frame 40) into the recess 30 from the back side of the display apparatus 10. At some point, the user can select one or more accessories 18 for display on the picture display apparatus 10. These accessories 18 can be created by the user or supplied as a set of pre-selected accessories 18. For instance, if the displayed picture shows a young child playing at the beach, the user could select a miniature beach ball or sea shells as the accessory 18 to adhere to the shelf 14. Thus, the user can personalize the picture by selecting the accessories 18 for display in such a manner that the accessories 18 and the picture (or other object) in the display area 16 are coordinated (e.g. the accessory and the displayed object share a theme or appearance).

Figure 4:
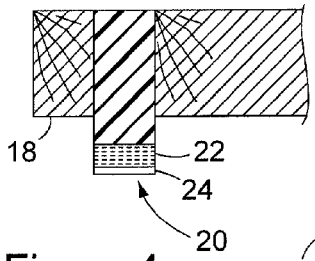
FIG. 4 illustrates a cross sectional view of an accessory to the picture display apparatus as seen from line 4-4 in FIG. 2.

To incorporate an accessory 18 into the picture display apparatus 10, he user peels off the cover 24 (see FIG. 4) from the adhesive 22 and adheres the accessory 18 to the shelf 14 using the adhesive 22. Additionally, if the user desires to change the appearance of the picture display apparatus 10, the accessories 18 that were adhered to the shelf can be removed and replaced with other accessories 18. In the alternative, the picture displayed in the display area 16 can be removed and replaced. In yet another alternative, the picture display apparatus 10, along with the accessories 18 on the shelf 14, can be moved to a different location. Because the picture display apparatus 10 is of sturdy one-piece construction and because the accessories 18 adhere to the shelf 14, these operations can be performed without causing the accessories to become dislodged due to movement of the picture display apparatus 10.

In view of the foregoing, it will be seen that the several advantages of the invention are achieved and attained. Picture display apparatus have been provided that can be personalized by the user. Also sturdy one-piece picture display apparatus (that include a frame and shelf) have been provided which allow the display of user selectable accessories. Moreover, the accessories provided by the present invention can remain with the picture display apparatus and in place even though the picture display apparatus may be moved, shaken or otherwise disturbed. Furthermore, picture display apparatus have been provided that allow the display of cross-stitched pictures while held in a taut condition by the associated cross-stitched pictures' stretcher frames.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the claims and their equivalents.

What is claimed is:

1. A picture display apparatus for displaying a picture, comprising:

a frame body including a border and an aperture display area that is defined by the border, the border having a front side and a rear side opposite the front side, wherein the border includes a step on the rear side, wherein the step defines an interior aperture for the border such that the interior aperture comprises the aperture display area and a second aperture area that is larger than the aperture display area, wherein the frame body is so dimensioned as to receive a stretcher frame within the second aperture area for engagement against the step such that a cross-stitched picture held in a taut condition by the stretcher frame can be displayed through the aperture display area; and the stretcher frame, wherein the stretcher frame is engaged against the step such that a cross-stitched picture held in a taut condition by the stretcher frame can be displayed through the aperture display area, wherein the stretcher frame is configured to hold a cross-stitched picture in a taut condition independently of whether the stretcher frame has been received by the frame body, and wherein the stretcher frame comprises:

a pair of dowels, each dowel having a slot for receiving a cross-stitched picture;

a pair of spreader rails for engagement with the dowels to define a perimeter for the stretcher frame; and a plurality of fasteners for securing the spreader rails to the dowels; and wherein at least one of the dowels is rotatable to draw a received cross-stitched picture taut within the stretcher frame.

2. The picture display apparatus of claim 1 wherein the frame body is so dimensioned as to receive the stretcher frame within the second aperture area for engagement against the step such that a cross-stitched picture held in a taut condition by the stretcher frame can be displayed through the aperture display area and such that the stretcher frame is concealed from view through the aperture display area from the front border side.

3. The picture display apparatus of claim 1 wherein the frame body is so dimensioned as to receive the stretcher frame within the second aperture area for friction engagement against the step such that a cross-stitched picture held in a taut condition by the stretcher frame can be displayed through the aperture display area.

4. The picture display apparatus of claim 1 wherein the stretcher frame perimeter is shaped such that the spreader rails extend beyond the dowels, and wherein the rear border side further comprises a plurality of notches through which portions of the spreader rails that extend beyond the dowels are insertable.

5. The picture display apparatus of claim 1 wherein the stretcher frame perimeter is shaped such that the dowels extend beyond the spreader rails, and wherein the rear border side further comprises a plurality of notches through which portions of the dowels that extend beyond the spreader rails are insertable.

6. The picture display apparatus of claim 1 wherein the border comprises a generally rectangular border.

7. The picture display apparatus of claim 6 wherein the aperture display area comprises a generally rectangular aperture display area.

8. The picture display apparatus of claim 1 further comprising means for holding the stretcher frame in place against the step.

9. The picture display apparatus of claim 1 further comprising the cross-stitched picture held in a taut condition by the stretcher frame for display through the aperture display area.

10. The picture display apparatus of claim 1 wherein the frame body is so dimensioned as to receive the stretcher frame within the second aperture area for engagement of the spreader rails against the step such that a cross-stitched picture held in a taut condition by the stretcher frame can be displayed through the aperture display area.

11. The picture display apparatus of claim 1 further comprising:

a shelf extending perpendicularly outward from the front border side at a lower portion of the front border side below the aperture display area, the shelf being so dimensioned as to support an accessory object for display thereon in conjunction with a cross-stitched picture held in a taut condition by the stretcher frame.

12. The picture display apparatus of claim 11 further comprising the accessory object.

13. A picture frame that can be personalized by a user, comprising:

an L-shaped frame body defining a substantially vertical member and a substantially horizontal member;

wherein the vertical member defines a frame border, the frame border defining an aperture display area for a front side of the frame body through which a picture can be displayed; and wherein the horizontal member defines a shelf extending outwardly from the front side of the frame body upon which an accessory object can be placed for display thereon in conjunction with the picture;

wherein the frame border is adapted with a step portion on a rear side thereof, thereby defining a first interior aperture area and a second interior aperture area, the first interior aperture area comprising the aperture display area and the second interior aperture area comprising an aperture area that is larger than the aperture display area such that the frame border is thereby adapted to accept a stretcher frame for engagement against the step portion; and wherein the picture frame further comprises the stretcher frame, wherein the stretcher frame comprises:

a pair of dowels, each dowel having a slot for receiving a cross-stitched picture;

a pair of spreader rails for engagement with the dowels to define a perimeter for the stretcher frame; and a plurality of fasteners for securing the spreader rails to the dowels; and wherein at least one of the dowels is rotatable to draw a received cross-stitched picture taut within the stretcher frame.

14. The frame of claim 13 further comprising the accessory, wherein the accessory comprises an integral adhesive for removably adhering the accessory to the shelf.

15. The frame of claim 14, further comprising a cover covering the adhesive and adapted to be peeled off of the adhesive prior to the accessory being removably adhered to the shelf.

16. The frame of claim 13, wherein the frame body and the shell are a single, unitary member.

17. The frame of claim 13 further comprising an adhesive that is integral to the shelf and located on an upward-facing portion of the shell such that an accessory can be removably adhered to the shell for display thereon via the adhesive.

18. The frame of claim 17 further comprising a cover covering the adhesive and adapted to be peeled off of the adhesive prior to the accessory being removably adhered to the shelf.

19. The frame of claim 13 further comprising the cross-stitched picture held in a taut condition by the stretcher frame for display through the aperture display area.

20. A method of personalizing a picture frame, comprising:

inserting a picture into a picture display frame that includes an L-shaped frame body defining a substantially vertical member and a substantially horizontal member, wherein the vertical member defines a frame border, the frame border defining an aperture display area for a front side of the frame body through which the inserted picture is displayed, and wherein the horizontal member defines a shelf extending outwardly from the front side of the frame body;

selecting an accessory from a plurality of pre-selected accessories; and placing the selected accessory on the shelf for display thereon in coordination with the inserted picture wherein the picture comprises a cross-stitched picture that is held in a taut condition by a stretcher frame, the stretcher frame comprising (1) a pair of dowels, each dowel having a slot for receiving a cross-stitched picture, (2) a pair of spreader rails for engagement with the dowels to define a perimeter for the stretcher frame, and (3) a plurality of fasteners for securing the spreader rails to the dowels, and wherein at least one of the dowels is rotatable to draw the cross-stitched picture taut within the stretcher frame, wherein picture display frame's frame body has a step on its rear side, and wherein the inserting step comprises:

combining the stretcher frame with the picture display frame by engaging the stretcher frame against the step such that the cross-stitched picture held in the taut condition by the stretcher frame is visible through the aperture display area from the front side of the frame body.

21. The method of claim 20 wherein the placing step comprises removably adhering the selected accessory to the shelf via an adhesive that is built into the shelf, wherein the adhesive comprises a peel-off cover, and wherein the placing step further comprises removing the peel-off cover from the adhesive prior to removably adhering the selected accessory to the shelf via the adhesive.

22. The method of claim 20 wherein the picture depicts an object, and wherein the selected accessory comprises a miniature replica of the object depicted in the picture.

23. The method of claim 20 further comprising:

removing the inserted picture from the picture display frame;

inserting a new picture into the picture display frame;

removing the selected accessory from the shelf;

selecting a different accessory from the plurality of pre-selected accessories; and placing the selected different accessory on the shelf for display thereon in coordination with the inserted new picture.

* * * * *